US005585580A

United States Patent [19]

Higgins

[11] Patent Number: 5,585,580

[45] Date of Patent: Dec. 17, 1996

[54] PEG BENDER

[76] Inventor: Bradley D. Higgins, 3753 East St., P.O. Box 191, Hartford, N.Y. 12838

[21] Appl. No.: 606,481

[22] Filed: Mar. 4, 1996

[51] Int. Cl.[6] ..... G10D 3/14

[52] U.S. Cl. ..... 84/312 R; 84/304; 84/453

[58] Field of Search ..... 84/312 R, 304, 84/267, 269, 327, 453

[56] References Cited

U.S. PATENT DOCUMENTS

| | | | |
|---|---|---|---|
| 3,686,993 | 8/1972 | Fender | 84/312 R |
| 4,147,087 | 4/1979 | Peters, Jr. et al. | 84/312 R |
| 4,535,670 | 8/1985 | Borisoff | 84/312 R |
| 5,140,884 | 8/1992 | Bowden | 84/312 R |
| 5,442,987 | 8/1995 | Davis | 84/312 R |

*Primary Examiner*—Patrick J. Stanzione

[57] ABSTRACT

The PEG BENDER is a small mechanical device that can be used on many stringed musical instruments. This device, mounted entirely on a special long-shafted tuning peg, is easily installed on most guitars, banjos, and four or five string mandolins. The PEG BENDER enables a musician to make extra note changes on that particular string in which it is employed, by merely pressing down or releasing the instrument's neck, thus tightening or loosening the activating cable between the PEG BENDER and the instrument's support strap. The extra note changes achieved with the PEG BENDER can be easily performed while still playing the instrument in a normal manner.

1 Claim, 3 Drawing Sheets

PEG BENDER

CROSS REFERENCES TO RELATED APPLICATIONS

References Cited U.S. Patent Documents

| | | |
|---|---|---|
| 5,140,884 | 8/1992 | Bowden |
| 3,686,993 | 8/1972 | Fender |
| 4,535,670 | 8/1985 | Borisoff |
| 5,442,987 | 8/1995 | Davis |

BACKGROUND OF THE INVENTION

Prior to my invention of the PEG BENDER, there were basically four types of string bending systems available. One type is hand lever operated which impairs the musicians's normal playing technique. Another type, has a lever connected to the instrument's support strap, enabling the musician to activate the device by pressing down or releasing the instrument's neck. This system was by far the most comfortable to utilize but it had major drawbacks. This system could only be installed on one style of guitar, also required drastic guitar modifications for installation, and also a firm pressure was necessary to counteract the weight compensation spring. A third device is hip activated, and though some what awkward to manipulate, is able to be installed on a guitar without any modifications. This system can be used on a wider variety of instruments than the previous system, but it is limited to use only on certain types of electric guitars. The last string bending system I will mention, is activated by an elbow lever suspended from the musician's shoulder, and awkwardly hanging under the musician's arm. This device is awkward to use and requires guitar modifications for installation.

The PEG BENDER combines the ease of operation of the strap lever systems, with the ease of installation of the hip activated system, and the versatility of being installable on all four and five string banjos, four and five string mandolins, and guitars (acoustic or electric, except those with twelve strings or slotted peg heads).

SUMMARY OF THE INVENTION

It is an object of the invention to perform a string bending function, with as little effort as possible on the part of the musician, so as not to deter the musician in any way, from at the same time, playing the instrument in a normal manner.

A further object of the invention is to provide a string bending function for a wider variety of musical instruments than previously achieved with other devices.

The final object of the invention is to provide string bending capabilities to a musical instrument without any modifications or damage to that musical instrument upon installation.

A BRIEF DESCRIPTION OF THE DRAWINGS

DETAILED DESCRIPTION OF THE INVENTION

Figure 1:
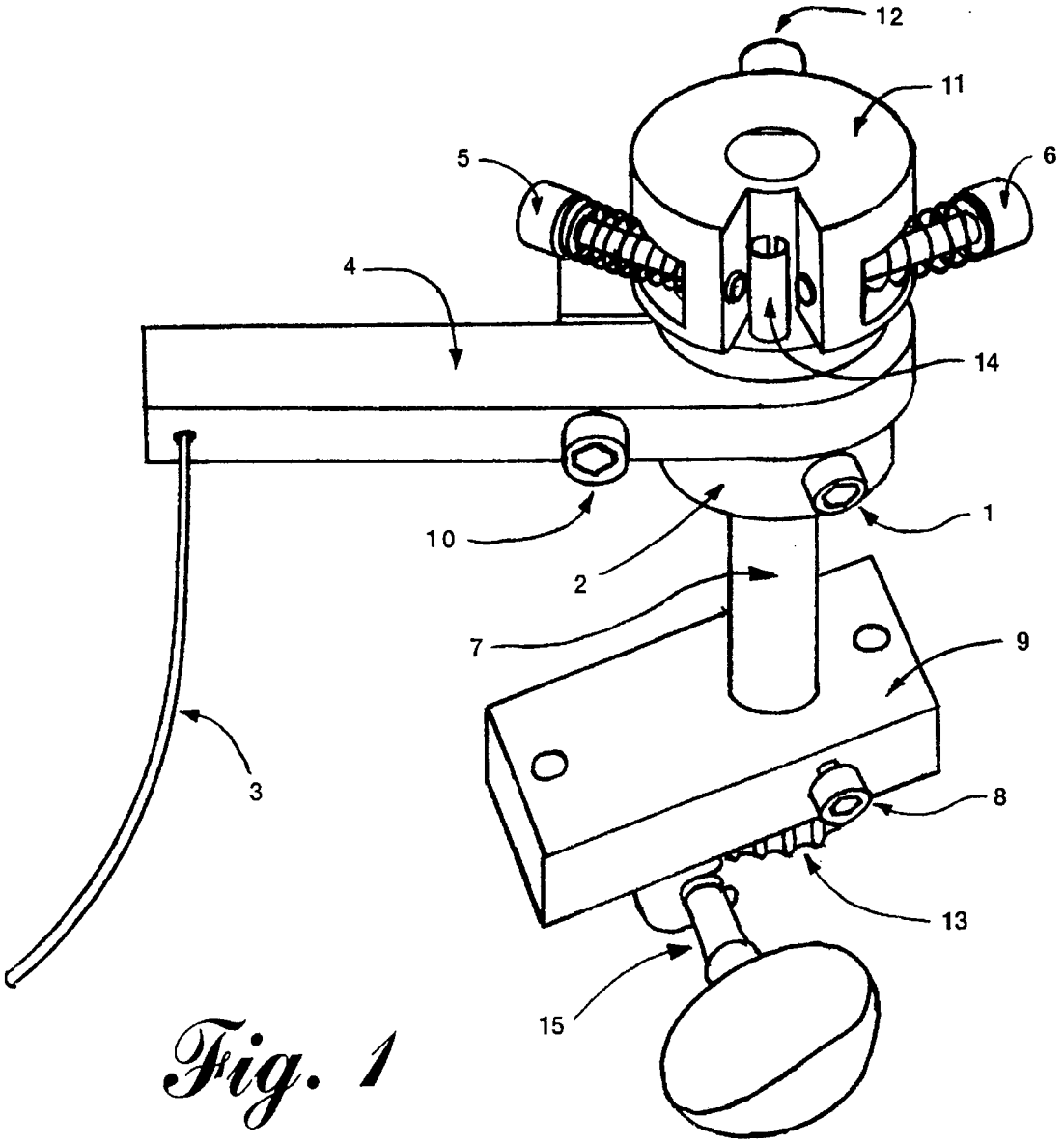
FIG. 1 is a view of the string bender apparatus titled PEG BENDER, not yet installed on a musical instrument.
Figure 2:
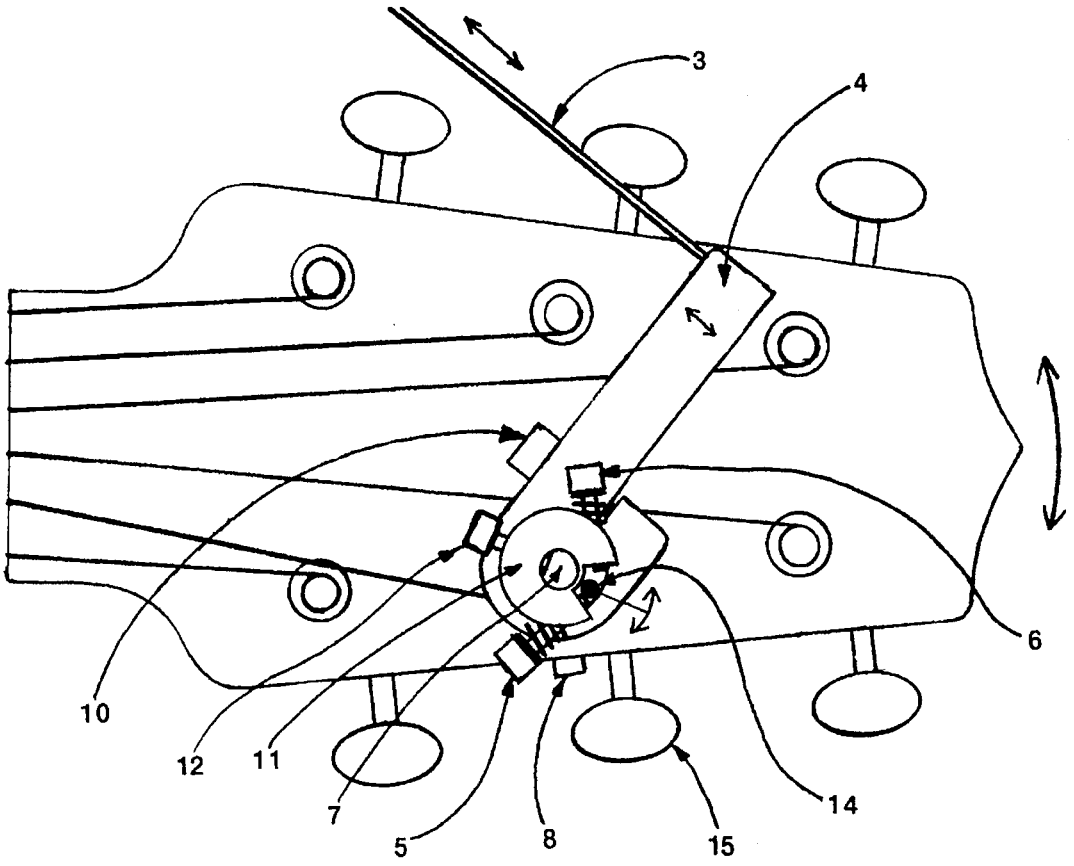
FIG. 2 is a view of the PEG BENDER installed on a guitar peghead with three tuning pegs per side.
Figure 3:
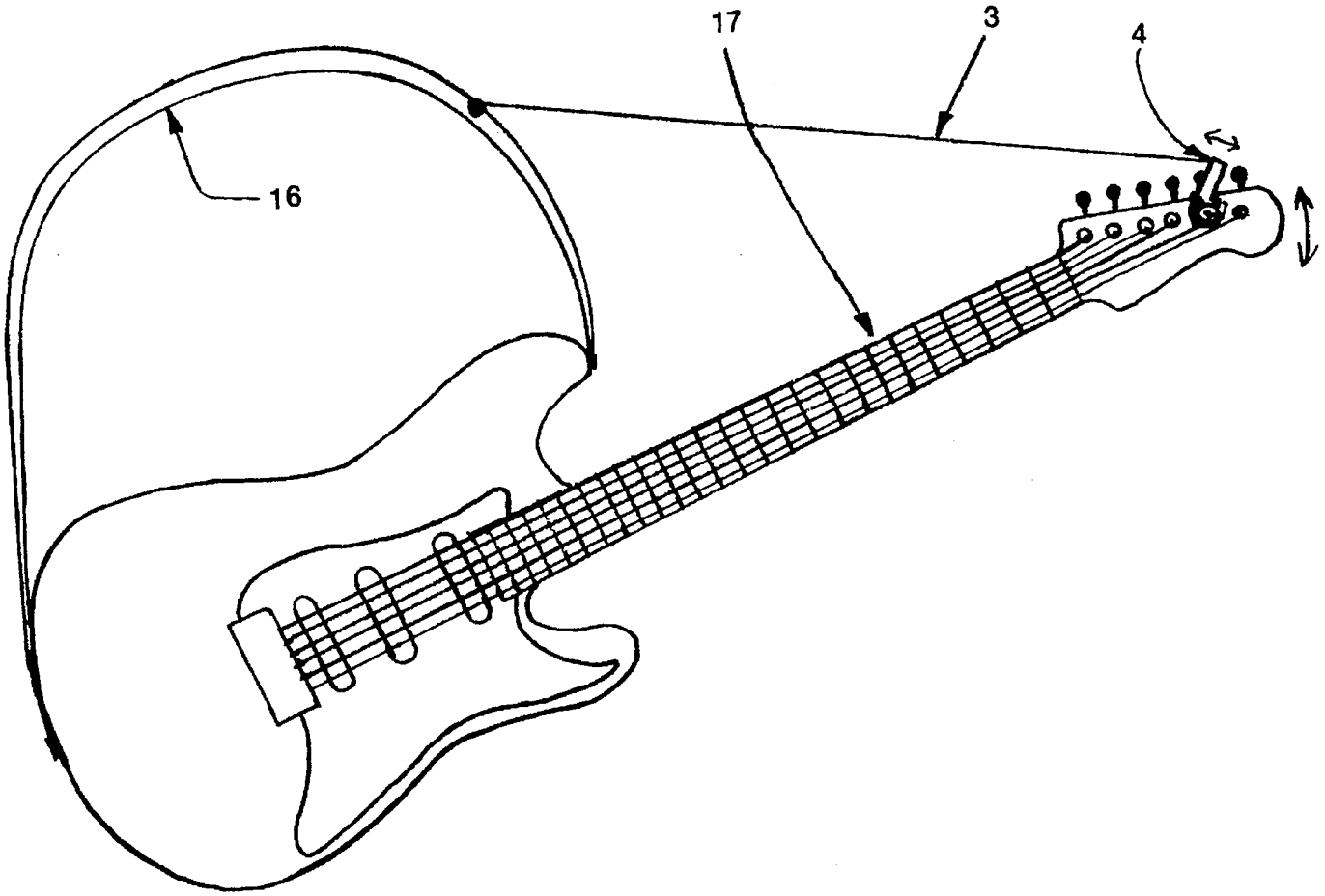
FIG. 3 is a view of an entire guitar, showing how the PEG BENDER is activated.

The PEG BENDER apparatus consists of a worm gear driven tuning peg 15 & 13, with an extra long shaft 7, mounted on a shaft locking block 9. Allen screw 8 locks the shaft in place once that string is in tune. At the top of the shaft 7 is a special adjusting head 11 that is fastened to the shaft 7 by allen screw 12. The adjusting head has two spring-loaded adjusting screws 5 & 6, which are used to adjust the movement of the limiting pin 14 that extends between them. The lower end of the limiting pin 14 is anchored in the string collar 2, and prevents it from otherwise rotating freely on the shaft 7. On the string collar 2 is an allen screw 1 that secures the string to the string collar 2. The cable lever 4 clamps around the string collar 2, and is adjusted by loosening allen screw 10. A small steel cable or string 3 is connected to the cable lever 4 at one end, and to the instrument support strap 16 at the other, thus allowing the device to be operated by lightly pressing down or releasing the musical instrument's neck 17.

What I claim as my invention is:

1. A tuning peg string bending device for stringed musical instruments such as guitars and banjos, comprising:

a musical instrument support strap for supporting said musical instrument;

a long shared worm gear tuning peg for manually tuning a particular string;

a locking block for locking said shaft of the tuning peg when the proper pitch is achieved;

a small cable connecting said tuning peg string bending device to said support strap such that when the neck of said instrument is pressed down and released, the tuning of the associated string is changed between two precise tunable notes without requiring the musician to in any way touch said tuning peg string bending device to operate it, thus enabling the musician to achieve extra note changes on the string in which said tuning peg string bending device is employed while still playing the musical instrument in a normal manner.

* * * * *